US007967155B2

(12) United States Patent
Klingspor et al.

(10) Patent No.: US 7,967,155 B2
(45) Date of Patent: Jun. 28, 2011

(54) STACKABLE COOLING RACK

(75) Inventors: Lisa Carolina Klingspor, Anderson, SC (US); Maureen Donoho, Goodlettsville, TN (US); James Hughes, Hendersonville, TN (US)

(73) Assignee: Electrolux Home Products, Inc., Cleveland, OH (US)

( * ) Notice: Subject to any disclaimer, the term of this patent is extended or adjusted under 35 U.S.C. 154(b) by 148 days.

(21) Appl. No.: 11/467,318

(22) Filed: Aug. 25, 2006

(65) Prior Publication Data

US 2008/0047916 A1 Feb. 28, 2008

(51) Int. Cl.
*A47B 7/02* (2006.01)
*B65D 21/032* (2006.01)

(52) U.S. Cl. ..... 211/153; 211/126.8; 211/126.11; 211/181.1; 108/91; 206/511

(58) Field of Classification Search ..... 211/37, 211/49.1, 126.2, 126.7, 126.8, 126.9, 126.11, 211/126.12, 128.1, 133.5, 149, 153, 181.1, 211/188, 194; 206/503, 504, 505, 507, 509, 206/511, 512; D6/462; 126/9 R, 333, 337 R; 108/53.1, 53.3, 91, 93, 181
See application file for complete search history.

(56) References Cited

U.S. PATENT DOCUMENTS 921,694 A * 5/1909 Hall ..... 211/126.11
1,386,878 A * 8/1921 Lamp ..... 211/126.11
2,190,065 A * 2/1940 Griffin ..... 211/85.26
2,662,682 A * 12/1953 Bolding ..... 229/120.13
2,776,775 A * 1/1957 Averill ..... 220/6
2,889,054 A * 6/1959 Wheeler ..... 211/153
2,892,562 A * 6/1959 Smithson ..... 220/7
2,916,293 A * 12/1959 Lang ..... 280/79.3
3,082,879 A * 3/1963 Wilson ..... 211/126.8
3,214,031 A * 10/1965 McCauley ..... 211/41.2
3,252,434 A * 5/1966 Young, Jr. ..... 108/181
D205,716 S * 9/1966 Christoffersen ..... D7/409
3,306,281 A * 2/1967 Hoebel ..... 126/25 R
3,314,549 A * 4/1967 Goldreich et al. ..... 211/132.1
3,349,939 A * 10/1967 Averill ..... 220/6
3,366,264 A * 1/1968 Panknin ..... 220/491
3,378,161 A * 4/1968 Lookabaugh ..... 220/6
3,523,694 A * 8/1970 Oliver ..... 280/33.998
3,524,565 A * 8/1970 Wilson ..... 220/491
3,606,025 A 9/1971 Wilson
3,704,791 A * 12/1972 Young, Jr. ..... 211/126.9
3,762,593 A * 10/1973 Beretta ..... 220/6
3,812,999 A * 5/1974 Joseph ..... 220/494
3,887,073 A * 6/1975 Wilson ..... 206/507
3,905,286 A * 9/1975 Le Grady ..... 99/450

(Continued)

*Primary Examiner* — Darnell M Jayne
*Assistant Examiner* — Joshua Rodden
(74) *Attorney, Agent, or Firm* — Pearne & Gordon LLP

(57) ABSTRACT

A rack for an appliance that can stack upon another rack. The rack includes a support platform having a support frame and a plurality of elongated support wires that form a support surface. The rack also includes a plurality of downwardly depending leg sections that can include a shoulder portion and a foot portion located below the shoulder portion. The rack also includes at least one cross member that can cooperate with the support platform to form a reception area that can receive a foot portion of a superjacent rack. In addition or alternatively, at least one reception area can be located vertically above a foot portion. In addition or alternatively, each foot portion includes an upturned portion. In addition or alternatively, the shoulder portion can enable the rack to be supported by a subjacent rack located within an interior cavity of an appliance.

18 Claims, 5 Drawing Sheets

U.S. PATENT DOCUMENTS 3,915,097 A * 10/1975 Young, Jr. ..... 108/6
3,977,529 A * 8/1976 Stroh ..... 211/187
4,015,712 A * 4/1977 Wadensten ..... 206/507
4,146,139 A * 3/1979 von Stein et al. ..... 211/126.9
4,191,160 A * 3/1980 Elliott ..... 126/9 R
4,298,127 A * 11/1981 Upshaw et al. ..... 211/126.9
4,383,611 A * 5/1983 Kreeger ..... 206/505
4,417,509 A * 11/1983 Deibel et al. ..... 99/467
4,444,320 A * 4/1984 Chap ..... 211/134
4,455,467 A 6/1984 Dills
4,805,785 A * 2/1989 Pfeifer et al. ..... 211/188
4,821,885 A * 4/1989 Ondrasik ..... 206/513
4,915,238 A * 4/1990 Cassel ..... 211/37
4,936,458 A * 6/1990 Tabler et al. ..... 206/507
5,035,335 A * 7/1991 Massoudnia ..... 211/188
5,074,223 A * 12/1991 Remmers ..... 108/91
5,097,971 A * 3/1992 Norris et al. ..... 211/126.6
5,103,799 A * 4/1992 Atanasio ..... 126/9 R
5,152,407 A * 10/1992 Massoudnia et al. ..... 211/126.8
5,494,253 A 2/1996 Snow
5,803,277 A * 9/1998 Alvarez-Momoitio ..... 211/188
5,823,100 A 10/1998 Wienhold et al.
D425,754 S * 5/2000 Matteson et al. ..... D7/409
6,318,570 B1 * 11/2001 Mueller et al. ..... 211/181.1
D455,029 S * 4/2002 Gusdorf ..... D6/462
D460,294 S * 7/2002 Webb et al. ..... D6/462
D485,092 S * 1/2004 Rosen ..... D6/465
6,766,730 B2 * 7/2004 Wrenn ..... 99/345
D553,860 S * 10/2007 Fernandez et al. ..... D3/307

* cited by examiner

STACKABLE COOLING RACK

RELATED APPLICATIONS

Not Applicable.

FIELD OF THE INVENTION

The present invention relates to racks for appliances, and more particularly, to a stack cooling rack for an oven

BACKGROUND OF THE INVENTION

Appliances, such as ovens, often have one or more racks generally within the appliance. For example, the racks can be useful for the placing of cookware, food, and other items, within the oven. The racks can place the cookware generally towards the middle of the oven, and can keep the cookware away from heating elements and the like. In addition, ovens with multiple racks allow for placement of cookware on a variety of levels within the oven, thereby increasing the total volume of available cooking.

The racks are often supported by ledges formed along the inner walls of the oven. The racks are then movable in and out of the oven on the ledges. This allows the racks to be removed from the oven for cleaning or for other purposes. Often, the racks may be partially removed from the oven so as to allow easier access to items placed on the racks. The ledges also facilitate vertical adjustment of the racks within the oven cavity.

Appliance racks, and specifically oven racks, are often of wire form construction. More specifically, an outer wire frame and a support platform, which is constituted by a plurality of fore-to-aft and laterally spaced wires, define a typical oven rack. The wires are generally evenly spaced across the entire rack for use in supporting food items to be cooked.

BRIEF SUMMARY OF THE INVENTION

The following presents a simplified summary of the invention in order to provide a basic understanding of some aspects of the invention. This summary is not an extensive overview of the invention. It is intended to identify neither key nor critical elements of the invention nor delineate the scope of the invention. Its sole purpose is to present some concepts of the invention in a simplified form as a prelude to the more detailed description that is presented later.

In accordance with an aspect of the present invention, a rack for an appliance is adapted to stack upon another rack. The rack includes a support platform having a support frame and a plurality of elongated support wires attached to the support frame to form a support surface extending along a plane. The rack also includes a plurality of downwardly depending leg sections. Each leg section has a shoulder portion and a foot portion located below the shoulder portion. Each foot portion includes an upturned portion. The rack also includes at least one cross member oriented transverse to the elongated support wires and attached to the elongated support wires. The cross member is spaced a distance apart from a portion of the support frame, and cooperates with the support platform to form at least one reception area adapted to receive a foot portion of a superjacent rack.

In accordance with another aspect of the present invention, a rack for an appliance is adapted to stack upon another rack. The rack includes a support platform having a support frame and a plurality of elongated support wires attached to the support frame to form a support surface extending along a plane. The rack also includes a plurality of downwardly depending leg sections. Each leg section has a shoulder portion and a foot portion located below the shoulder portion. The shoulder portion is adapted to enable the rack to be supported by a subjacent rack located within an interior cavity of an appliance. The rack also includes at least one cross member oriented transverse to the elongated support wires and attached to the elongated support wires. The cross member is spaced a distance apart from a portion of the support frame, and cooperates with the support platform to form at least one reception area adapted to receive a foot portion of a superjacent rack.

In accordance with another aspect of the present invention, a rack for an appliance is adapted to stack upon another rack. The rack includes a support platform having a support frame and a plurality of elongated support wires attached to the support frame to form a support surface extending along a plane. The rack also includes a plurality of downwardly depending leg sections. Each leg section has a foot portion including an upturned portion. The rack also includes at least one cross member having a generally loop-shaped geometry. The cross member cooperates with a portion of the support platform to form at least one reception area that is adapted to receive a foot portion of a superjacent rack. A portion of the cross member extends a distance beyond the support frame such that the reception area is located vertically above the foot portion.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF AN EXAMPLE EMBODIMENT

Figure 1:
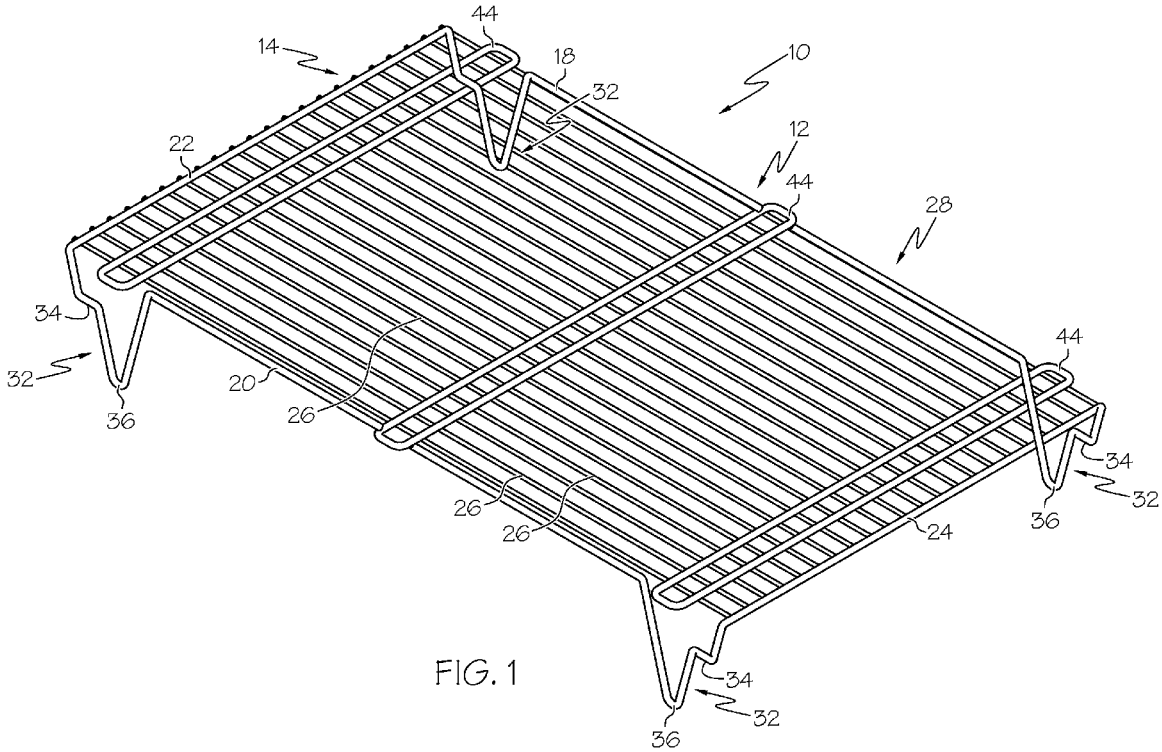
FIG. 1 illustrates a perspective view of an example rack in accordance with one or more aspects of the present invention.

An example embodiment of a rack that incorporates aspects of the present invention is shown in the drawings. It is to be appreciated that the shown example is not intended to be a limitation on the present invention. For example, one or more aspects of the present invention can be utilized in other embodiments and even other types of racks.

Figure 2:
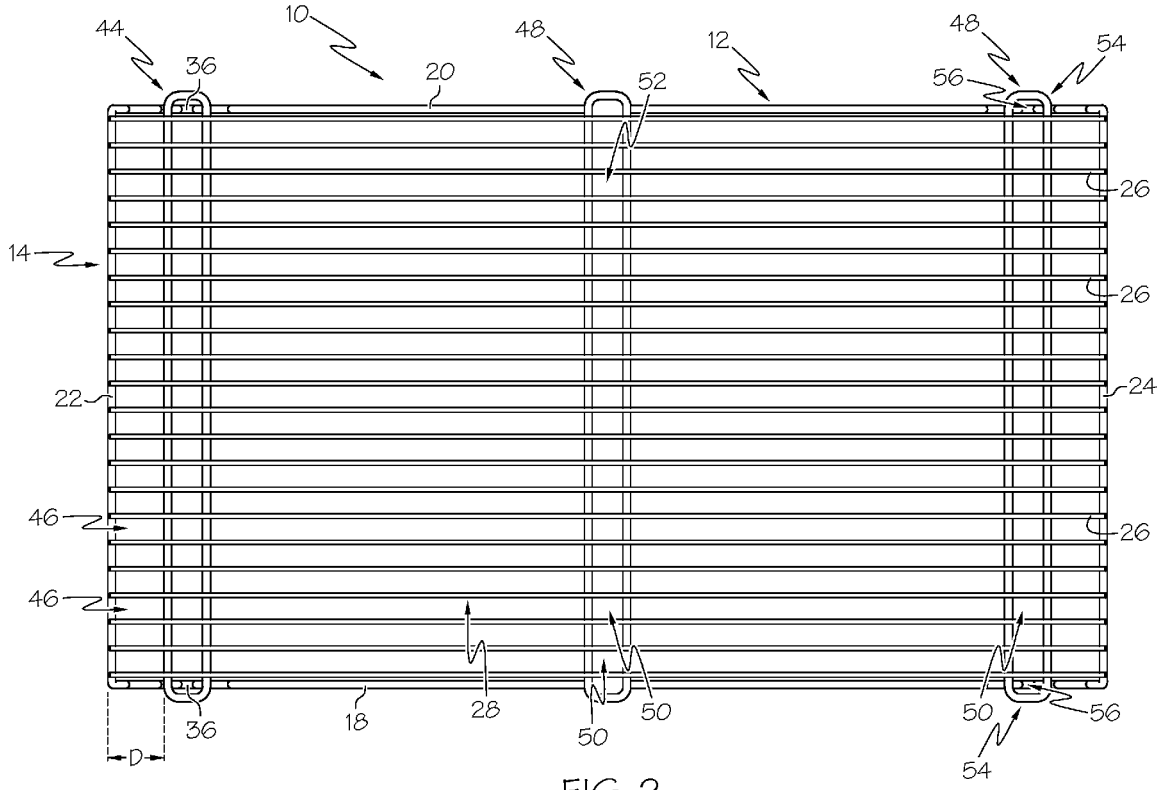
FIG. 2 illustrates a top view of the rack of FIG. 1.

Turning to the shown example of FIGS. 1 and 2, an example of a stack cooling rack 10 for an appliance, such as an oven, is illustrated in accordance with an aspect of the present invention. The stack cooling rack 10 includes a support platform 12 having a support frame 14 and a plurality of elongated support wires 26. Both of the support platform 12 and support frame 14 can be constructed from metal wire, such as iron coated with nickel or steel coated with porcelain. However, it is to be appreciated that the support platform 12 and support frame 14 can be constructed from various other suitable materials (e.g., various other metals and/or sheet metal).

The support frame 14 can include a front wire 18, a rear wire 20, and opposed side wires 22, 24. The front wire 18, rear wire 20, and side wires 22, 24 can be attached together to form the support frame 14 in various manners, such as by welding, adhesives, or fasteners, and/or can even be formed from a single piece of wire. The front wire 18, rear wire 20, and side wires 22, 24 can include a single or multiple elements. As shown, the support frame 14 can have a generally rectangular geometry, through it is to be appreciated that the support frame 14 can have various other geometries.

The plurality of elongated support wires 26 can be attached to the support frame 14. The elongated support wires 26 can be welded, or otherwise secured, to the support frame 14. It is to be appreciated that the elongated support wires 26 can extend between any of the front, rear, or side wires 18, 20, 22, 24 and can be oriented at various angles relative to the support frame 14. The elongated support wires 26 can be manufactured from metal wire or various other suitable materials, coated or uncoated, that provide adequate strength to support various items such as cake pans, baking stones, casseroles, or the like, and can withstand the heat of an oven.

The elongated support wires 26 can form a support surface 28 extending along a plane 30 (see FIG. 5) defined by the intermediate wires 26. The support surface 28 can have a generally planar geometry so as to provide an area configured to support various items, such as cake pans, cookie sheets, casseroles, and/or a baking stone (not shown).

The stack cooling rack 10 can also include a plurality of downwardly depending leg sections 32. For example, as shown, the stack cooling rack 10 can include four leg sections 32. Each of the leg sections 32 can be attached to the support frame 14 using various methods, such as by welding, adhesives, or fasteners, and/or can even be formed from a single piece of wire. In addition or alternatively, each of the leg sections 32 can be formed with the support frame 14. The leg sections 32 can be formed of metal wire, such as iron coated with nickel or steel coated with porcelain, or of various other suitable materials that provide adequate strength to support the stack cooling rack 10 and various items supported thereon, and can withstand the heat of an oven.

The leg sections 32 can include various features, such as a shoulder portion 34 and/or a foot portion 36. In one example, the leg sections 32 can include a shoulder portion 34 and not a foot portion 36. Conversely, the leg sections 32 can include a foot portion 36 and not a shoulder portion 34. As shown, where the leg sections 32 include both, the foot portion 36 can be located below the shoulder portion 34, though other configurations are also contemplated. Additionally, the leg sections 32 can include a generally V-shaped or U-shaped geometry 41.

Figure 4:
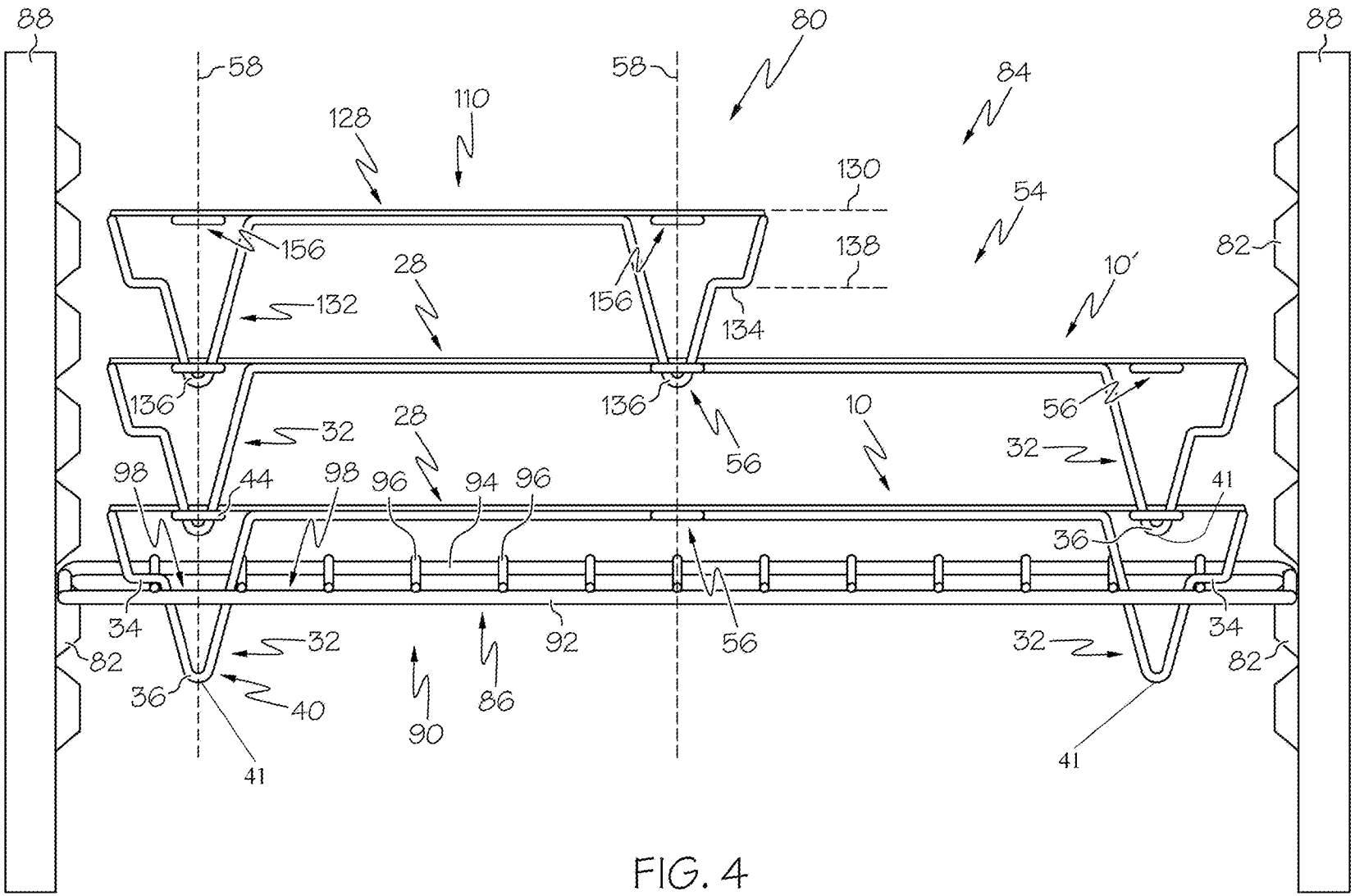
FIG. 4 illustrates front view of a plurality of stacked racks that are supported within an interior cavity of an appliance.

Either or both of the shoulder portion 34 and the foot portion 36 can be configured to permit the rack 10 to be supported by various subjacent support surfaces, including other racks. In one example, the shoulder portion 34 can be adapted to enable the rack to be supported by a subjacent rack located within an interior cavity of an appliance. As shown in FIG. 4, the shoulder portion 34 can be adapted to enable the rack 10 to be supported by an oven rack 86 that is supported within an interior oven cavity 84. Thus, as shown, an oven arrangement 80 can include side walls 88 having guide rails 82 attached to and/or formed therewith. As is known in the art, the guide rails 82 can be configured to support a conventional oven rack 86 within the oven cavity 84. Also as is known in the art, the conventional oven rack 86 can include a support frame 90 that includes a front wire 92, rear wire 94, and elongated support wires 96 attached therebetween. The support wires 96 can be arranged in a spaced apart relationship to form gaps or empty spaces 98 therebetween.

The foot portion 36 of each leg section 32 can be received by the gaps 98.

As shown, each foot portion 36 can be relatively narrower than each gap 98 such that each foot portion 36 can be easily inserted into and/or removed from each gap 98. Additionally, each shoulder portion 34 can be configured to rest upon one or more of the support wires 96 of the oven rack 86. Thus, when the foot portion 36 is inserted into a gap 98, the shoulder portion 34 can act as a support for supporting the rack 10, and as a stop for positioning and aligning the rack 10 relative to the oven rack 86. For example, the shoulder portion 34 can extend laterally inward relative to the side wires 22, 24 of the rack 10, though it can also be oriented in various other manners. Additionally, the shoulder portion 34 can extend along a plane 38 generally parallel to the plane 30 of the support surface 28 of the rack 10 to enable the support surface 28 to be oriented generally parallel to the subjacent oven rack 86 to facilitate the supporting of various items thereon. It is to be appreciated that the rack 10 can also be adapted to be supported by a subjacent rack located within the interior cavity of various other appliances, such as, for example, a refrigerator, freezer, dishwasher, and/or microwave oven.

Figure 5:
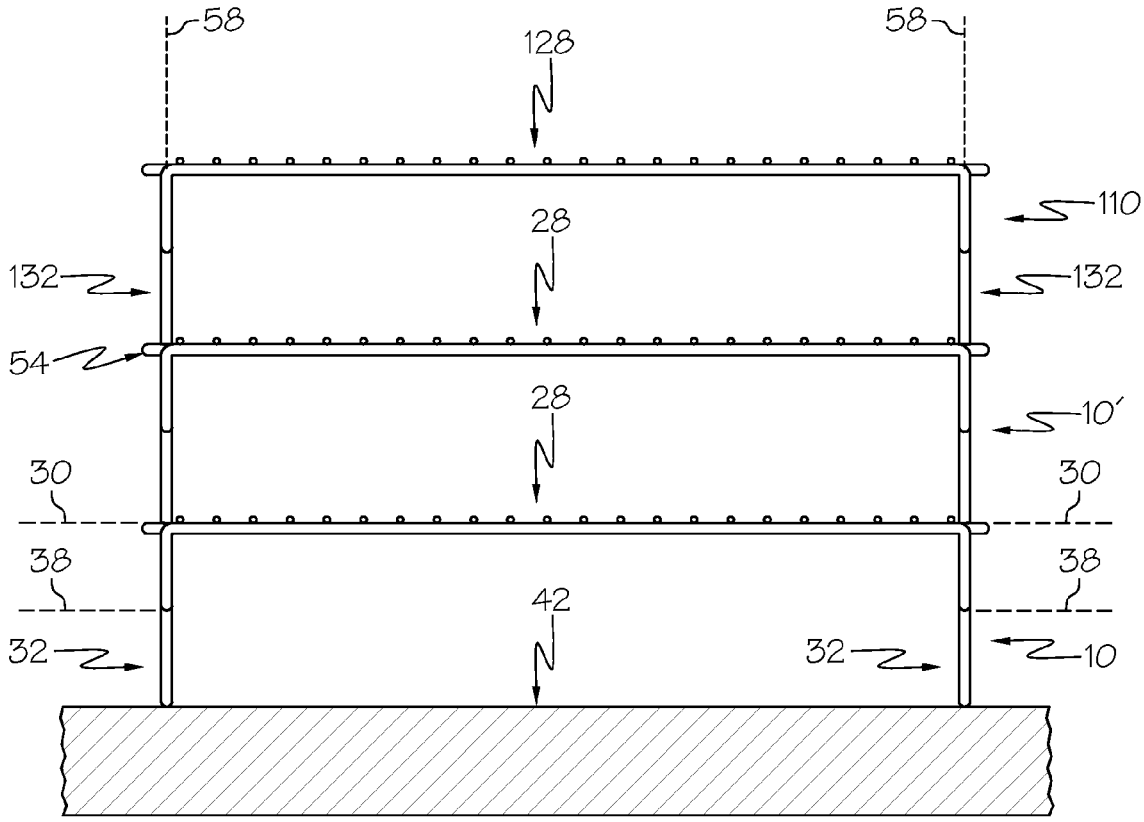
FIG. 5 a side view of a plurality of stacked racks that are supported by a surface that does not include wire structure.

In addition or alternatively, the foot portion 36 of the rack 10 can be configured to support the rack 10 on various surfaces. For example, the foot portion 36 can include an upturned portion 40. As shown, the upturned portion 40 can be formed from the generally V-shaped or U-shaped geometry 41 of the leg section 32. The upturned portion 40 can have various geometries, such as a curved geometry, a U-shaped geometry, a semi-circular geometry, or even a square geometry. In one example, as shown in FIG. 5, the upturned portion 40 can permit the rack 10 to be supported by a surface 42 that does not contain wire structure, such as a countertop, shelf or cooktop. In another example, the upturned portion 40 can permit the rack 10 to be supported by structure of a subjacent rack 10, as will be discussed more fully herein.

Turning back to the examples shown in FIGS. 1-2, the rack 10 can also include at least one cross member 44. The cross member 44 can be oriented at various angles relative to the elongated support wires 26. In one example, the cross member 44 can be oriented transverse to the support wires 26. Additionally, the cross member 44 can be attached to support frame 14 and/or the support wires 26 in various manners, including adhesives, fasteners, or welding, and/or can even be formed with either or both of the support frame 14 or support wires 26. The cross member 44 can also operate to mitigate sagging of the support platform 12 with respect to the support frame 14 when heavy food, cookware, or the like (not shown) is placed on the support platform 12. Thus, the cross member 44 can include various materials and/or geometries, such as a larger diameter wire.

The cross member 44 can cooperate with a portion of the support platform 12 (e.g., the support frame 14 and/or the support wires 26) for forming one or more reception area(s) 46, 50, 56 that can be adapted to receive a foot portion 36 of a superjacent rack for support thereof when the racks are stacked. In one example, the foot portion 36 of a superjacent rack can be relatively narrower than the width of a corresponding reception area 46, 50, 56 such that the foot portion 36 can be easily received into and removed from the reception area. Additionally, a progressively widening geometry of the V-shaped or U-shaped leg section 32 can inhibit the depth to which the foot portion 36 can be received into the reception area 46, 50, 56. Thus, as shown in FIG. 4, when the foot portion 36 of a superjacent rack 10' is received within the reception area 46, 50, 56 of a subjacent rack 10, the geometry of the leg section 32 can cooperate with the reception area 46, 50, 56 to thereby support the superjacent rack 10' upon the subjacent rack 10.

The cross member 44 can cooperate with the support platform 12 to form various reception areas 46, 50, 56. In one example, as shown in FIG. 2, the cross member 44 can be spaced a distance D apart from a portion of the support frame 14 (e.g., the side wire 22, 24) and can cooperate with the support wires 26 to form at least one reception area 46. Thus, the reception area 46 can be defined by the support frame 14 (e.g., the side wire 22, 24), the support wires 26, and the cross member 44. When the cross member 44 extends across a plurality of support wires 26, the rack 10 can include a plurality of reception areas 46.

In another example, as shown in FIG. 2, the cross member 44 can include a generally loop-shaped geometry 48. That is, the cross member 44 can have a shape that is circular or curved over on itself, though it is to be appreciated that the loop-shaped geometry 48 may or may not include a fully enclosed loop. For example, the loop-shaped geometry 48 could include an opening to form a C-shaped geometry or the like. Additionally, some or all of the cross members 44 can include the loop-shaped geometry 48.

The reception area 50 can be defined within an interior area 52 of the loop-shaped cross member 48, and can be formed between the cross member 44 and the support wires 26. Additionally, where the cross member 44 cooperates with a plurality of support wires 26, a plurality of reception areas 50 can be formed between the cross member 44 and the support wires 26. Even further still, the rack 10 can include a plurality of loop-shaped cross members 48 to accommodate the stacking of racks having various sizes.

In yet another example, a portion 54 of the loop-shaped cross member 48 can extend a distance beyond the support frame 14 such that a reception area 56 is located vertically above a foot portion 36. As such, the reception area 56 can be generally vertically aligned with the foot portion 36 along a vertical axis 58 (see FIG. 5). Thus, when the various racks 10 are stacked upon each other, the reception area 56 can facilitate alignment of the racks 10. Additionally, because the loop-shaped cross member 48 can extend a distance beyond the support frame 14, and because each foot portion 36 can be located vertically below a reception area 56, substantially the entire support surface 28 of each rack 10 can be used for supporting various items. That is, as shown in FIG. 5, the leg sections 32 can intrude little, if any, upon the usable storage space of each rack 10. Accordingly, the rack 10 can permit a user to make a greater use of the available space within an oven cavity 84 or on a countertop 42, even when the racks 10 are stacked.

Figure 3:
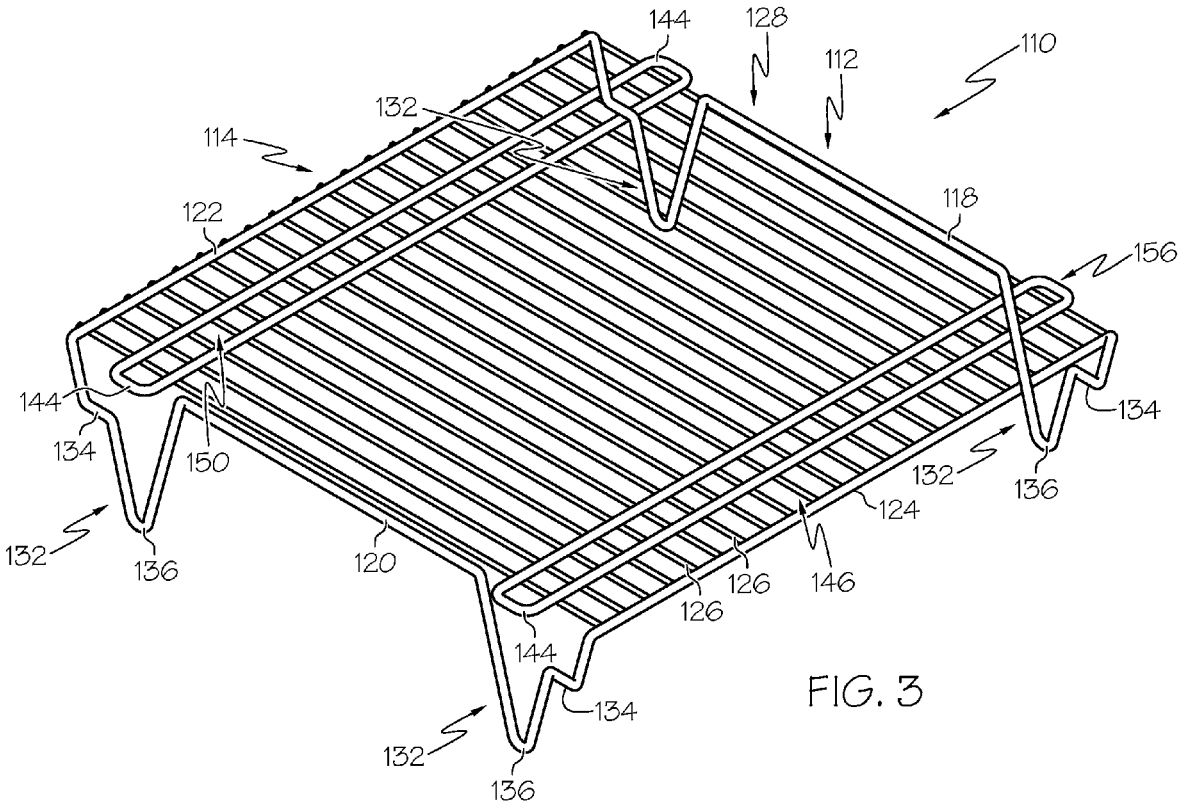
FIG. 3 illustrates a perspective view of another example rack in accordance with another aspect of the present invention.

Turning now to the example shown in FIG. 3, another example stack cooling rack 110 is illustrated in accordance with another aspect of the present invention. As shown in FIG. 4, the alternate stack cooling rack 110 can be relatively smaller than the previously discussed stack cooling rack 10. As shown, the alternate rack 110 can be approximately half the size of the previously discussed stack cooling rack 10. Thus, when used together, the alternate stack cooling rack 110 can support relatively smaller items, and/or the previously discussed stack cooling rack 10 can support relatively taller items in an empty space 54 provided by the relatively smaller size of the alternate rack 110. Additionally, because of the smaller size of the alternate rack 110, it is to be appreciated that the relatively larger stack cooling rack 10 can include correspondingly positioned cross members 48 and reception areas 46, 50, 56 to accommodate the leg sections 132 of the alternate rack 110.

As before, the alternate stack cooling rack 110 can include a support platform 112 and a support frame 114 constructed from metal wire or the like, and the support frame 114 can have a front wire 118, a rear wire 120, and opposed side wires 122, 124 attached thereto and/or formed from a single piece of wire. A plurality of intermediate wires 126 can be attached to the support frame 114, and can extend between any of the front, rear, or side wires 118, 120, 122, 124 and can be oriented at various angles relative to each other and/or the support frame 114. Further still, a portion of the intermediate wires 126 can form support surface 128 configured to support cookware, food, and/or other items within the oven. The rack 110 can include a plurality of leg sections 132 each having a shoulder portion 134 and foot portion 136. The rack 110 can also include at least one cross member 144 configured to provide reception areas 146, 150. As before, the cross member(s) 144 can have a loop-shaped geometry, and the shoulder portion 134 can extend along a plane 138 generally parallel to the plane 130 of the support surface 128.

In operation, with the stack cooling rack 10, 110 supported within the oven cavity 84, the support surface 28, 128 of the stack cooling rack 10, 110 can be utilized to support various items for cooking within the oven. In addition or alternatively, various items can also be supported on other conventional oven racks 86 simultaneously without the need to add or remove any other racks. Further, as shown in FIG. 4, additional items can be supported within the oven cavity 84 for cooking by adding (e.g., stacking) additional stack cooling racks 10, 110. Further still, the stacking of various stack cooling racks 10, 110 can permit a user to vary the distance between an item to be cooked and a heat source (e.g., a distance between food and a broiler).

Additionally, upon removal from the oven cavity 84, the stack cooling racks 10, 110 can be supported by a surface 42 that does not contain wire structure, such as countertop or the like. As such, the stack cooling rack 10, 110 can be utilized as a cooling rack for cooling the various items contained thereon after having been baked in the oven 80. The open structure of the rack 10, 110 (e.g., the spacing of the various wires, etc.) can facilitate the cooling of the items. It is to be appreciated that the stack cooling rack 10, 110 can function independently as either an oven rack or a cooling rack.

It is to be appreciated that the racks of the subject invention can be used in settings other than in an oven. For example, the racks of the subject invention could be used in a refrigerator and/or freezer unit. Further, it is to be appreciated that the racks can be constructed of any suitable material, such as metal, plastic, and the like. Further still, the frame, the bars, and the cross-member(s) need not be constructed from the same materials.

The size of the frame of the rack of the subject invention also depends upon the intended use of the rack. In the example embodiments, the rack is sized to slide into or replace a rack of a conventional oven. Likewise, the bars are spaced to accommodate cookware. The frame can be made larger to fit commercial ovens or sized to fit any apparatus in which the racks are to be used. The bars of the rack can be spaced appropriately within the frame to hold any designated item.

The invention has been described with reference to various example embodiments. Obviously, modifications and alterations will occur to others upon a reading and understanding of this specification. It is intended to include all such modifications and alterations insofar as they come within the scope of the appended claims or the equivalents thereof.

What is claimed is:

1. A rack for an appliance which is adapted to stack upon another rack, comprising;

a support platform having a support frame having a frontmost wire portion, a rearmost wire portion, and opposed outermost side wire portions and a plurality of elongated support wires attached to the support frame to form a support surface extending along a plane;

a plurality of downwardly depending leg sections each coupled to one of the frontmost wire portion and the rearmost wire portion, each leg section having a shoulder portion and a foot portion located below the shoulder portion, each foot portion including an upturned portion; and at least one cross member having a generally loop-shaped geometry oriented transverse to the elongated support wires and attached to an underside of the elongated support wires, the cross member being spaced a distance apart from a portion of the support frame such that a portion of the loop-shaped cross member extends a distance beyond each of the frontmost wire portion and the rearmost wire portion of the support frame, wherein each portion of the at least one loop-shaped cross member that extends a distance beyond the support frame is located vertically above a corresponding foot portion and is generally aligned along a vertical axis extending through said corresponding foot portion, and the at least one cross member cooperating with the support platform to form at least two reception areas each adapted to receive a foot portion of a superjacent rack, each leg section including a progressively widening V-shaped geometry which is configured to inhibit the depth that the foot portion is received in a respective reception area of a subjacent rack, wherein the shoulder portion is configured to support the rack on a oven rack with the support surface at a first distance from the oven rack, and wherein the foot portion is configured to support the rack on another rack with the support surface at a second distance from a support surface of the another stack rack and on a flat surface with the support surface at a third distance from the flat surface, wherein the second distance is greater than the first distance and less than the third distance.

2. The rack of claim 1, wherein a plurality of said reception areas are formed within an interior area of the loop-shaped cross member, the reception areas being formed between the cross member and the elongated support wires.

3. The rack of claim 1, wherein the upturned portion of the foot portion is adapted to enable the rack to be supported by a surface that does not include wire structure.

4. The rack of claim 1, wherein the rack is adapted to be supported by a subjacent rack located within an interior cavity of an appliance.

5. The rack of claim 4, wherein the shoulder portion is adapted to enable the rack to be supported by an oven rack that is supported within an interior oven cavity.

6. The rack of claim 1, wherein the plurality of leg sections are formed with the support frame.

7. The rack of claim 1, wherein the shoulder portion of each leg section is disposed closer to an adjacent outermost side wire portion relative to the foot portion, and wherein the shoulder portion extends laterally inwardly within a boundary defined by the support surface and generally parallel to the plane of the support surface.

8. A rack for an appliance which is adapted to stack upon another rack, comprising;

a support platform having a support frame having a frontmost wire portion, a rearmost wire portion, and opposed outermost side wire portions, and a plurality of elongated support wires attached to the support frame to form a support surface extending along a plane;

a plurality of downwardly depending leg sections each coupled to one of the frontmost wire portion and the rearmost wire portion, each leg section including a generally V-shaped geometry having a shoulder portion the generally V-shaped geometry of each leg section including a progressively widening V-shaped geometry which is adapted to inhibit the depth that the foot portion is received in a respective reception area of a subjacent rack, and a foot portion located below the shoulder portion, the shoulder portion being adapted to enable the rack to be supported by a first subjacent rack located within an interior cavity of an appliance with the support surface at a first distance from the first subjacent rack; and at least one cross member having a fully-enclosed loop-shaped geometry oriented transverse to the elongated support wires and attached to an underside of the elongated support wires, the cross member being spaced a distance apart from a portion of the support frame such that a portion of the loop-shaped cross member extends a distance beyond each of the frontmost wire portion and the rearmost wire portion of the support frame, the cross member cooperating with the support platform to form at least one pair of reception areas each located a distance beyond the frontmost wire portion and the rearmost wire portion and vertically above a foot portion of one of the plurality of legs and generally aligned along a vertical axis extending through said foot portion, and wherein the foot portion is configured to support the rack on a second subjacent rack with the support surface of the rack at a second distance from a support surface of the second subjacent rack, and wherein the foot portion is configured to support the rack on a flat surface with the support surface at a third distance from the flat surface, further wherein the second distance is greater than the first distance and less than the third distance.

9. The rack of claim 8, wherein the shoulder portion is adapted to enable the rack to be supported by an oven rack that is supported within an interior oven cavity while said foot portion penetrates therethrough.

10. The rack of claim 8, wherein a plurality of said reception areas are formed within an interior area of the loop-shaped cross member, the reception areas being formed between the cross member and the elongated support wires.

11. The rack of claim 8, further including a second cross member having a fully-enclosed loop-shaped geometry oriented transverse to the elongated support wires and attached to an underside of the elongated support wires, the second cross member being spaced a distance apart from a portion of the support frame such that a portion of the second loop-shaped cross member extends a distance beyond each of the frontmost wire portion and the rearmost wire portion of the support frame such that another pair of reception areas are each located a distance beyond the frontmost wire portion and the rearmost wire portion and vertically above a foot portion of one of the plurality of legs and generally aligned along a vertical axis extending through said foot portion.

12. The rack of claim 8, wherein each foot portion includes an upturned portion.

13. The rack of claim 12, wherein the upturned portion of the foot portion is adapted to enable the rack to be supported by a surface that does not include wire structure.

14. The rack of claim 8, wherein the shoulder portion of each leg section is disposed closer to an adjacent outermost side wire portion relative to the foot portion, and wherein the shoulder portion extends laterally inwardly within a boundary defined by the support surface and generally parallel to the plane of the support surface.

15. A rack for an appliance which is adapted to stack upon another rack, comprising;

a support platform having a support frame having a frontmost wire portion, a rearmost wire portion, and opposed outermost side wire portions and a plurality of elongated support wires attached to the support frame to form a support surface extending along a plane;

a plurality of downwardly depending leg sections each coupled to one of the frontmost wire portion and the rearmost wire portion, each leg section having a shoulder portion and a foot portion located below the shoulder portion, each foot portion including an upturned portion;

a first and a second cross member, each having a generally loop-shaped geometry defining a fully enclosed loop, the first and second cross members cooperating with portions of the support platform so that each of the cross members form at least two reception areas each adapted to receive a corresponding foot portion of a superjacent rack, opposing portions of the first and second cross members each extending a distance beyond the support frame such that each of the at least two reception areas are located between respective ends of the first and second cross members and the support frame, each of the reception areas being further located vertically above the foot portion of one of the plurality of legs and generally aligned along a vertical axis extending through said foot portion, and a third cross member having a generally loop-shaped geometry attached to an underside of the elongated support wires and being disposed intermediate the first and second cross members, each leg section including a progressively widening V-shaped geometry which is configured to inhibit the depth that the foot portion is received in a respective reception area of a subjacent rack, wherein each shoulder portion is configured to support the rack on a oven rack with the support surface at a first distance from the oven rack, wherein the foot portion is configured to support the rack on a subjacent rack with the support surface at a second distance from a support surface of the subjacent rack, and wherein the foot portion is configured to support the rack on a flat surface with the support surface at a third distance from the flat surface, wherein the second distance is greater than the first distance and less than the third distance.

16. The rack of claim 15, wherein the upturned portion of the foot portion is adapted to enable the rack to be supported by a surface that does not include wire structure.

17. The rack of claim 15, wherein the shoulder portion of each leg section is disposed closer to an adjacent outermost side wire portion relative to the foot portion, and wherein the shoulder portion extends laterally inwardly and generally parallel to the plane of the support surface.

18. The rack of claim 15, wherein a portion of the first cross member is oriented transverse to the elongated support wires and cooperates with the support wires to form said reception areas.

* * * * *